US006884182B2

(12) United States Patent
Nardacci

(10) Patent No.: US 6,884,182 B2
(45) **Date of Patent: *Apr. 26, 2005**

(54) GOLF BALL WITH AN IMPROVED INTERMEDIATE LAYER

(75) Inventor: Nicholas Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 45 days.

This patent is subject to a terminal disclaimer.

(21) Appl. No.: 10/377,659

(22) Filed: Mar. 4, 2003

(65) Prior Publication Data

US 2003/0153407 A1 Aug. 14, 2003

Related U.S. Application Data

(63) Continuation of application No. 10/028,826, filed on Dec. 28, 2001, now Pat. No. 6,629,898.

(51) Int. Cl.[7] ..... A63B 37/06
(52) U.S. Cl. ..... 473/374
(58) Field of Search ..... 473/373, 374, 473/370

(56) References Cited

U.S. PATENT DOCUMENTS

| | | | | | |
|---|---|---|---|---|---|
| 4,274,637 | A | | 6/1981 | Molitor | 273/235 R |
| 4,431,193 | A | | 2/1984 | Nesbitt | 273/235 R |
| 4,674,751 | A | | 6/1987 | Molitor et al. | 273/235 R |
| 5,314,187 | A | | 5/1994 | Proudfit | 273/235 R |
| 5,334,673 | A | | 8/1994 | Wu | 273/235 R |
| 5,484,870 | A | | 1/1996 | Wu | 528/28 |
| 5,803,831 | A | | 9/1998 | Sullivan et al. | 473/374 |
| 5,830,087 | A | | 11/1998 | Sullivan et al. | 473/385 |
| 5,836,831 | A | | 11/1998 | Stanton et al. | 473/354 |
| 5,857,926 | A | | 1/1999 | Sullivan et al. | 473/378 |
| 5,885,172 | A | | 3/1999 | Hebert et al. | 473/354 |
| 5,922,252 | A | | 7/1999 | Stanton et al. | 264/4 |
| 5,984,807 | A | * | 11/1999 | Wai et al. | 473/376 |
| 6,012,991 | A | * | 1/2000 | Kim et al. | 473/374 |
| 6,012,992 | A | | 1/2000 | Yavitz | 473/378 |
| 6,132,324 | A | | 10/2000 | Hebert et al. | 473/378 |
| 6,174,245 | B1 | | 1/2001 | Stanton et al. | 473/354 |
| 6,379,270 | B2 | * | 4/2002 | Maruko et al. | 473/377 |
| 6,406,385 | B1 | * | 6/2002 | Masutani et al. | 473/378 |
| 6,503,155 | B2 | * | 1/2003 | Maruko et al. | 473/370 |
| 6,629,898 | B2 | * | 10/2003 | Nardacci | 473/373 |

* cited by examiner

*Primary Examiner*—Raeann Gorden
(74) *Attorney, Agent, or Firm*—Swidler Berlin Shereff Friedman, LLP

(57) ABSTRACT

The present invention is directed towards a golf ball which comprises a core, a cover and at least one improved intermediate layer disposed between core and the cover. The intermediate layer a composite of at least two dissimilar materials that is radially oriented and transversely isotropic so that the layer provides unique performance properties when the ball is struck with different clubs.

27 Claims, 6 Drawing Sheets

GOLF BALL WITH AN IMPROVED INTERMEDIATE LAYER

CROSS-REFERENCE TO RELATED APPLICATIONS

This application is a continuation of U.S. patent application Ser. No. 10/028,826 filed Dec. 28, 2001 now U.S. Pat. No. 6,629,898.

FIELD OF THE INVENTION

This invention relates generally to golf balls having at least one intermediate layer that is a radially oriented, transversely isotropic composite. The intermediate layer is formed of two materials with different material properties so that the layer provides unique performance properties when the ball is struck with different clubs.

BACKGROUND OF THE INVENTION

Generally, golf balls have been classified as wound balls or solid balls. Wound balls are generally constructed from a liquid or solid center surrounded by tensioned elastomeric material. Wound balls are generally thought of as performance golf balls and have good resiliency, spin characteristics and feel when struck by a golf club. However, wound balls are generally more difficult to manufacture than solid golf balls.

Early solid golf balls were generally two piece balls, i.e., comprising a core and a cover. More recently developed solid balls have a core, an intermediate layer and a cover, in order to improve the playing characteristics of the ball.

The prior art is comprised of a variety of golf balls that have been designed to provide particular playing characteristics. These characteristics are generally the initial velocity and spin of the golf ball, which can be optimized for various types of players. For instance, certain players prefer a ball that has a high spin rate in order to control and stop the golf ball. Other players prefer a ball that has a low spin rate and high resiliency to maximize distance. Generally, a golf ball having a hard core and a soft cover will have a high spin rate. Conversely, a golf ball having a hard cover and a soft core will have a low spin rate. Golf balls having a hard core and a hard cover generally have very high resiliency for distance, but are hard feeling and difficult to control around the greens. Various prior art references have been directed to adding an intermediate layer of core material or second cover layer to improve the playability of solid golf balls.

Golf ball manufacturers, however, are continually searching for new ways in which to provide golf balls that deliver good performance for golfers.

SUMMARY OF THE INVENTION

The present invention is directed to a golf ball with a core, a cover and an improved intermediate layer disposed between the core and the cover. The improved intermediate layer is a composite that is radially oriented and transversely isotropic. The layer provides unique performance properties when the ball is struck with different clubs.

In one embodiment, the improved intermediate layer is formed with a sufficient thickness to alter the playing characteristics of the ball and respond differently to different types of clubs. The material properties of the materials forming the improved intermediate layer are preferably selected such that the properties of the layer can be changed by varying the percentage of each of the constituents forming the layer or by changing the position, dimensions or configuration of the two materials with respect to each other.

One embodiment of the present invention is a golf ball having a core, a cover and an intermediate layer that is made of an interstitial material distributed throughout a binding material. The interstitial material may be distributed symmetrically within the layer, and more particularly may be spherically symmetric with the remaining parts of the ball. In addition, the interstitial material may be radially oriented or circumferentially oriented.

In another embodiment, the ratio of the elastic modulus of the interstitial material to the elastic modulus of the binding material is about 3:1 or greater, while in another embodiment this ratio is between about 5:1 and about 10:1.

In yet another embodiment, the ratio of the interstitial material long-time shear modulus to the binding material long-time shear modulus is about 30:1 or less. It is preferred in one embodiment that the ratio of the interstitial material long-time shear modulus to the binding material long-time shear modulus is about 3:1 or greater, and even more preferably is between about 5:1 and about 10:1.

The intermediate layer may be of any desired thickness. In one embodiment, however, the intermediate layer has a thickness between about 0.080 inches and about 0.340 inches. More preferably, the intermediate layer is between about 0.125 inches and about 0.250 inches thick.

The interstitial material may be formed in any manner desired. In one embodiment, the interstitial material is formed of discrete pieces of material, while in another embodiment it is formed of a continuous piece of material. Preferably, the material that forms the interstitial material is a fiber or a plurality of fibers.

Portions of the intermediate layer may extend into the preceding (i.e., inner) or subsequent (i.e., outer) layer of the ball. In one embodiment, the interstitial material extends outward into the layer surrounding the outer surface of the intermediate layer, while in another embodiment the interstitial material extends inward into the material on the inner surface of the intermediate layer. In one embodiment, however, the layer surrounding the outer surface of the intermediate layer is a cover. In a preferred embodiment, the cover is separate from the intermediate layer so that no material from the intermediate layer extends into the inner surface of the cover.

In yet another embodiment, at least one intermediate layer has at least one material property in the radial direction that is different from that property in the circumferential direction. For example, the intermediate layer may have a material property in the radial direction that is larger than that property in the circumferential direction. One such material property may be the elastic modulus.

DETAILED DESCRIPTION OF THE PREFERRED EMBODIMENTS

Figure 1:
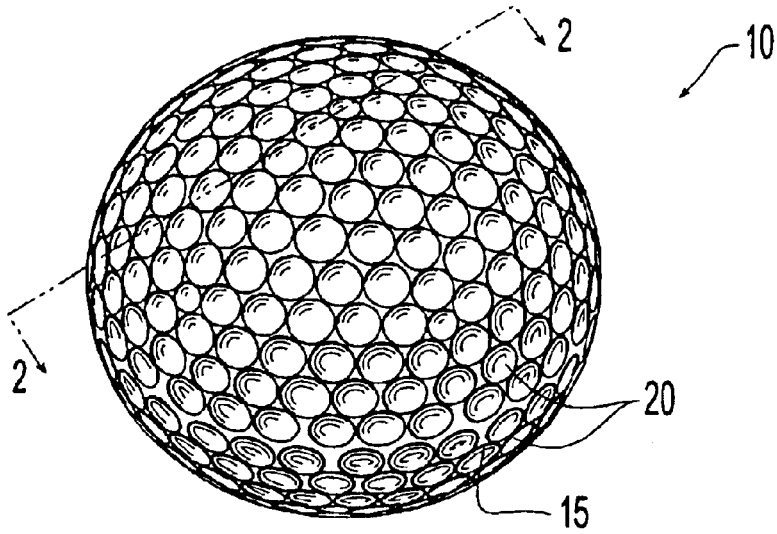
FIG. 1 is a side view of a golf ball according to the present invention.
Figure 2:
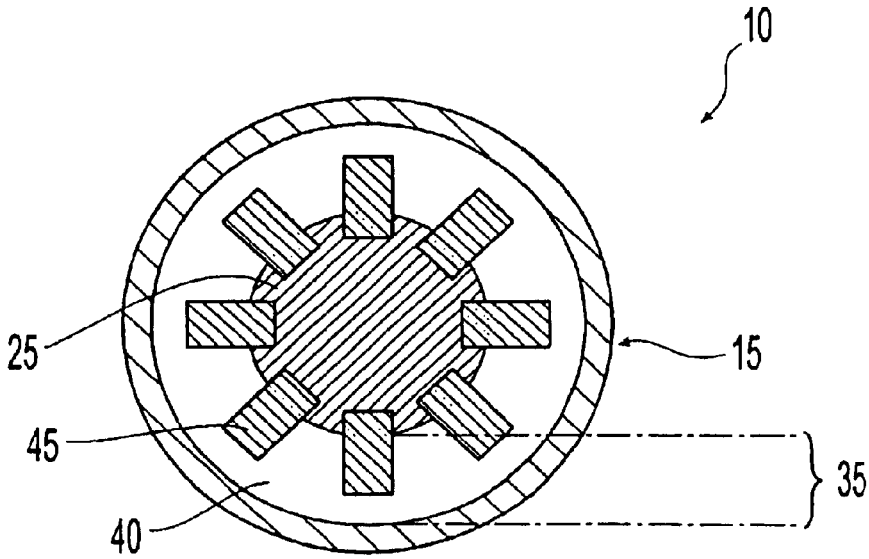
FIG. 2 is a cross-sectional view along the line 2—2 of FIG. 1 of a first embodiment of the golf ball according to the present invention.

The present invention is directed to a golf ball having an intermediate layer disposed between the cover and the core. The intermediate layer is a radially oriented, transversely isotropic composite. Referring to FIGS. 1 and 2, a golf ball 10 of the present invention is substantially spherical and has a cover 15 that may include a plurality of dimples 20 formed on the outer surface thereof.

Referring to FIG. 2, the golf ball 10 further includes a core 25 and at least one composite intermediate layer 35 disposed between the core 25 and the cover 15. Preferably, there is a single intermediate layer.

Suitable core materials include thermosets, such as rubber, polybutadiene, polyisoprene; thermoplastics such as ionomer resins, polyamides or polyesters; or a thermoplastic elastomer. A conventional core composition that comprises polybutadiene as known by one of ordinary skill in the art can be used. Suitable thermoplastic elastomers include Pebax®, Hytrel®, thermoplastic urethane, and Kraton®, which are commercially available from Elf-Atochem, DuPont, various manufacturers, and Shell, respectively. The core materials can also be formed from a castable material. Suitable castable materials include urethane, polyurea, epoxy, and silicone. One skilled in the art would appreciate that other materials and combinations thereof may be used in the present invention.

Referring to FIG. 2, the intermediate layer 35 is formed of a binding material 40 and an interstitial material 45 distributed in the binding material 40. The interstitial material 35 is radially oriented in the intermediate layer and symmetrically distributed. Preferably, the interstitial material is oriented so that a central axis of the interstitial material is co-axial with a radius line of the ball. Alternatively, the interstitial material may vary within 15 degrees of the radius line of the ball. Preferably, the interstitial material is positioned such that it has spherical symmetry with the ball. In one embodiment of the present invention, the interstitial material 45 may extend from the intermediate layer 35 into the core 25. In an alternative embodiment, the interstitial material can also be embedded in the cover, or be in contact with the inner surface of the cover, or be embedded only in the cover.

It is preferred that the interstitial material 35 be formed of at least one fiber, and more preferably a plurality of fibers that are discrete pieces of material. In another embodiment, interstitial material 35 may also be formed of a fiber that is continuous piece of material. Alternatively, the interstitial material can be projections. Preferably, the projections should be substantially uniform in length, although the projections may also be varied in length. For example, the projections may vary in length by less than about 20 percent, more preferably varying by less than about 10 percent, so that ball performance is not adversely affected by the variations. In some cases, varying the length or other dimensions of the projections may be desired. For instance, the projections may be varied in length, width or cross-sectional profile in a predetermined manner so that the performance of the intermediate layer can be further customized without adversely affecting ball flight or symmetry. These variations may be selected to assist in efficiently transferring energy from the cover of the golf ball when the ball is struck by a club head to the core of the golf ball. In instances where the projections are varied in a predetermined manner, the variations are preferably balanced so that the center of gravity of the ball approximately coincides with the spherical center of the ball.

A number of fiber geometries, packing factors, and fiber sizes can be used or combined to achieve different performance characteristics of the intermediate layer while maintaining symmetry. Thus, the layer, for example, can be designed to exhibit particular spin characteristics for driver, iron, and half wedge launch conditions.

It is recommended that the thickness of the intermediate layer 35 range from about 0.080 inches to 0.340 inches. It is preferred that the thickness of the intermediate layer 35 is between about 0.125 and about 0.250 inches.

Figure 2A:
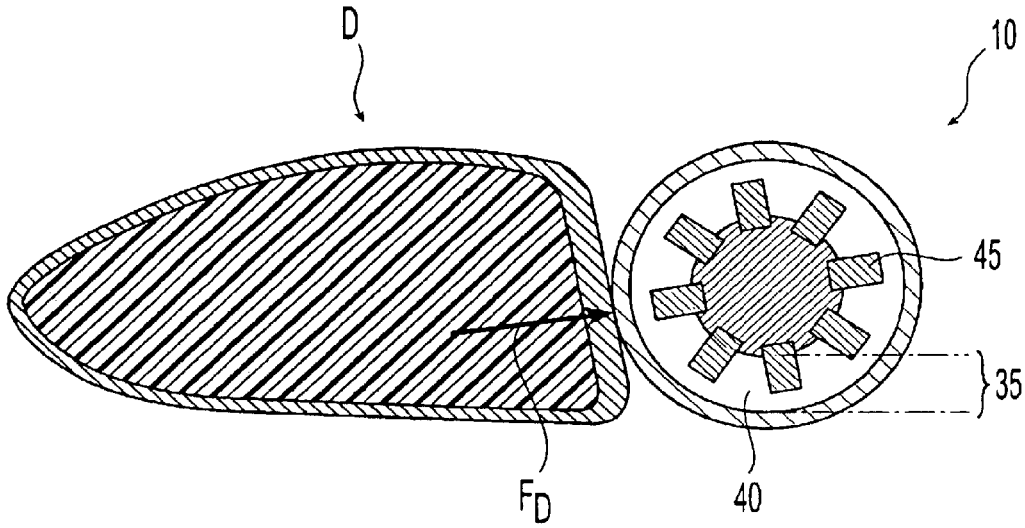
FIG. 2A is a schematic, cross-sectional view of a driver and an iron impacting the ball of FIG. 2.
Figure 2A:
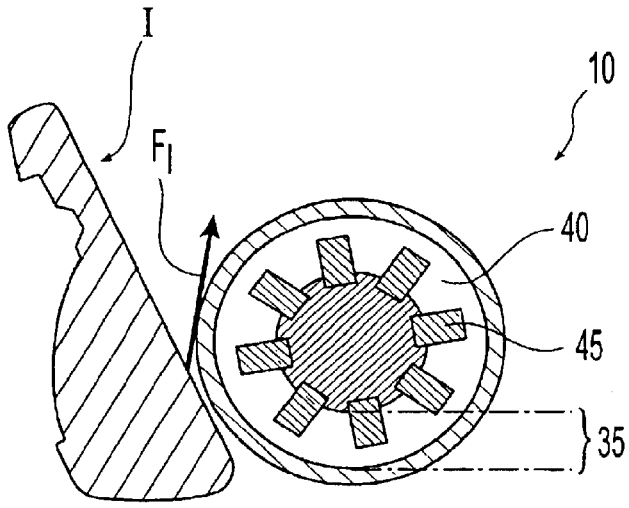
Figure 3:
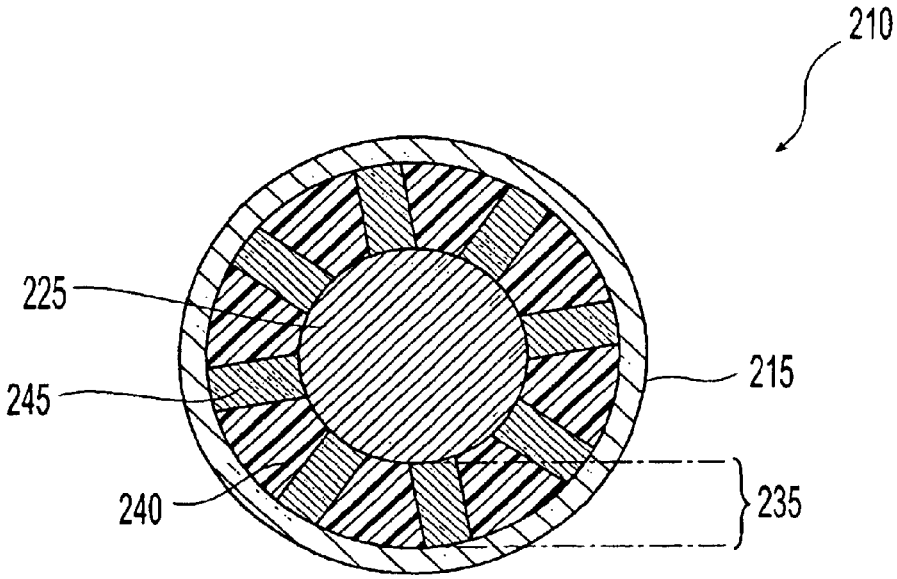
FIG. 3 is a cross-sectional view of a second embodiment of the golf ball according to the present invention.
Figure 4:
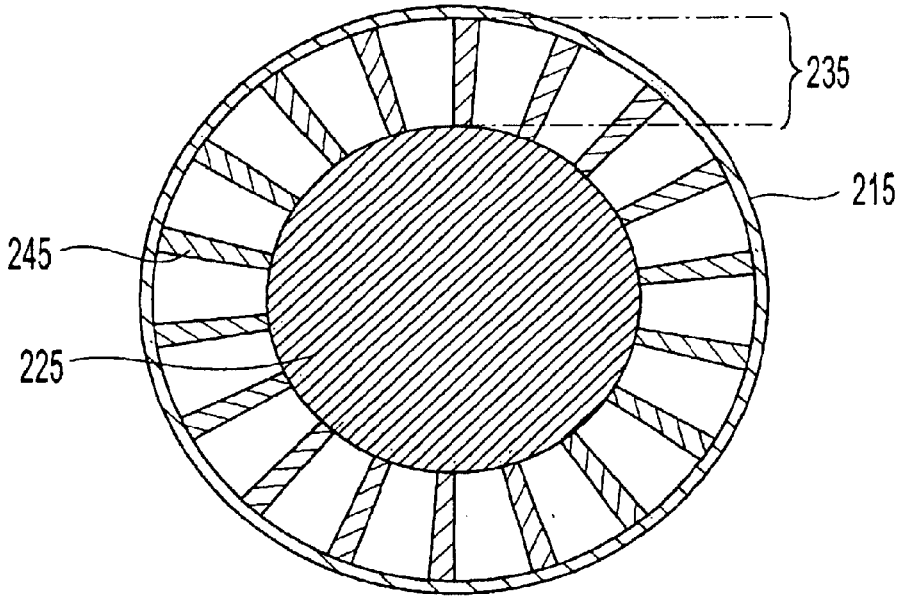
FIG. 4 is a cross-sectional view of an intermediate layer of the golf ball of FIG. 3 without a core and cover.
Figure 5:
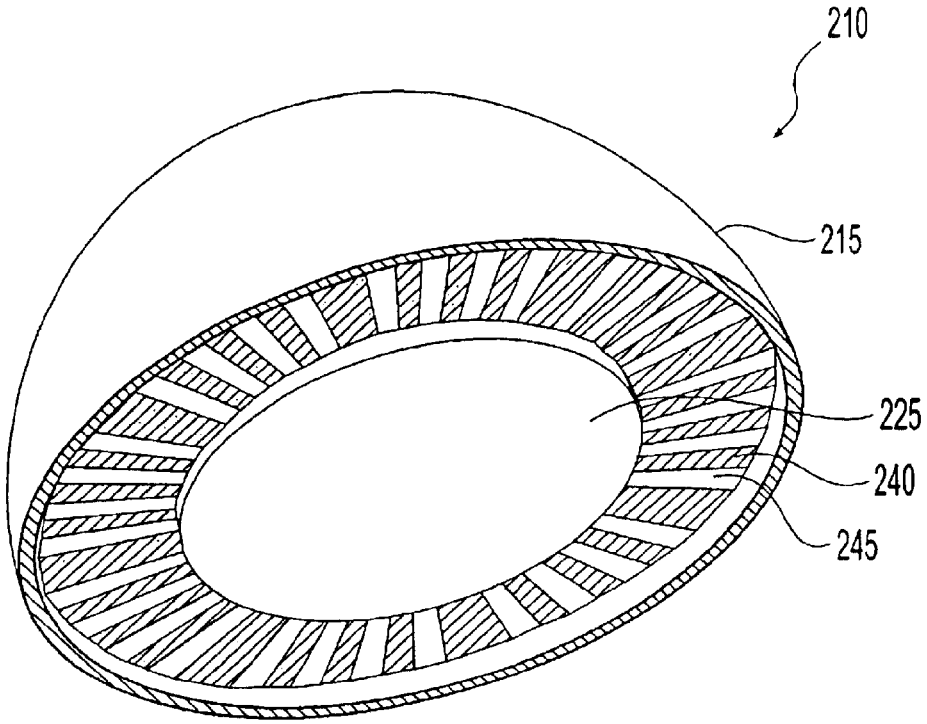
FIG. 5 is a perspective view of a hemisphere of the intermediate layer material of FIG. 4.
Figure 6:
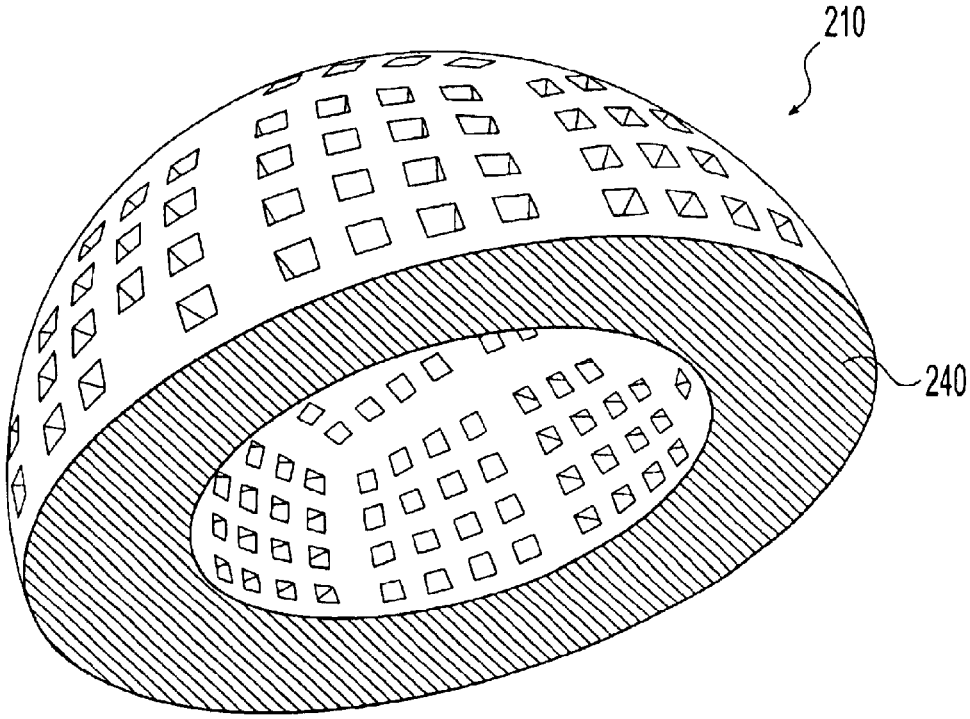
FIG. 6 is a perspective view of the hemisphere of the intermediate layer of FIG. 4 with an interstitial material removed.
Figure 7:
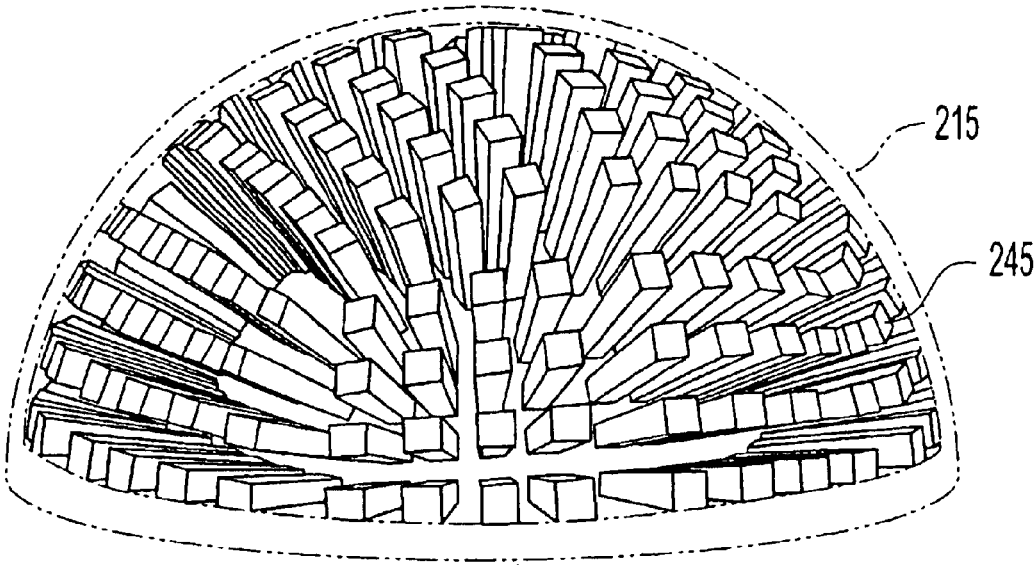
FIG. 7 is a side, perspective view of the hemisphere of the intermediate layer of FIG. 6 with the interstitial material removed and the cover shown in phantom.

The materials used for the binding material and interstitial material, are selected so that the desired playing characteristics of the ball are achieved. The desired playing characteristics of the inventive ball are that the effective material properties of the intermediate layer are different depending upon the magnitude and direction of the applied force. Referring to FIG. 2A, two illustrations are shown of a driver D impacting the inventive ball 10 and a short iron impacting the inventive ball 10. The short irons include a 8 iron through the lob wedge (LW), and include a series of wedges such as the pitching wedge PW, the sand wedge SW and the lob wedge LW. The long-irons are the 1 iron through the 4 iron and the mid-irons are the 5 iron through the 7 iron. The ball may be constructed with varying combinations of binding material and interstitial material depending on the desired performance of the ball. The physical dimensions and arrangement of interstitial material and binding material also may be varied according to the desired play of the ball.

It is preferred that during driver D impact, a driver force $F_d$ is substantially normal to the outer surface of the ball. The ball 10, due to the intermediate layer material properties and geometry, exhibits a first material property in this direction which is more closely coupled to the impact force $F_d$. That is to say, the component of force is largest in the radial sense and that the ball response is more closely governed by the material properties in the first material direction. Preferably, such driver impact force $F_D$ is more closely coupled to the radially oriented fibers 45.

It is preferred that during short iron I impact, an iron impact force $F_1$ is substantially tangent to the outer surface of the ball. The ball 10, due to the intermediate layer material properties and geometry, exhibits a second material property value different than the material property value exhibited when the ball is struck by a driver. That is to say, the component of force is largest in the tangential sense and that the ball response is more closely governed by the material properties in the second material direction. Preferably, such short iron impact force $F_1$ is more closely coupled to the binding material. Thus, the ball response is dependent on the magnitude and direction of the applied force at impact.

Table 1, below, is representative of the impact forces that may be imparted to a ball when it is struck by a low handicap player. While the values provided in Table 1 are illustrative, one skilled in the art would appreciate that normal and tangential force components imparted to a ball may vary for a number of reasons, such as club face angle, swing speed, and the like.

TABLE 1

| Club | Normal Force | Tangential Force | Force Ratio | Spin Fraction |
|---|---|---|---|---|
| Driver | 1324 | 506 | 2.61 | 0.36 |
| 3 iron | 1098 | 464 | 2.36 | 0.39 |
| 5 iron | 951 | 574 | 1.66 | 0.52 |
| 8 iron | 641 | 697 | 0.92 | 0.74 |
| wedge | 368 | 669 | 0.55 | 0.88 |
| ½ wedge | 65 | 345 | 0.19 | 0.98 |

As the club selection progresses from driver to half wedge, the forces imparted on the ball change from primarily being normal to the ball maximizing distance, to primarily being tangent to the ball so that the impact generates high ball spin. The normal direction is defined as the component of force that is perpendicular to the dynamic loft of the club face at impact, while the tangential direction is defined as the component of force that is planar to the dynamic loft of the club face at impact. In particular, because the intermediate layer is transversely isotropic, it can be designed to respond differently to normal or tangential impact forces. Thus, the desired performance characteristics can be achieved which maximize driver distance while providing short game spin and control.

The change in normal and tangential force components imparted to a ball when struck by different types of clubs can be expressed as a "force ratio", which is defined as the ratio of normal to tangential force components of the applied load at impact. As illustrated in Table 1, the force ratio decreases as the club selection progresses from a driver to a half wedge. The normal force component described above is the component of the impact force that acts in the radial direction of the ball, while the tangential force component is the component of the impact force that acts in the plane that is tangent to the ball at the point of impact.

As explained above, it is preferred that the properties of the interstitial material becomes increasingly dominant in the effective properties of the intermediate layer as the force ratio becomes increasingly higher. For instance, it is preferred that the interstitial material properties predominate the effective properties of the intermediate layer when the force ratio is about 2.0 or greater, and more preferably when the force ratio is about 2.25 or greater.

Conversely, it is preferred that the binding material becomes increasingly dominant in the effective properties of the intermediate layer as the force ratio is reduced. For example, it is preferred that the binding material properties predominate the effective properties of the intermediate layer when the force ratio is about 1.75 or less, and more preferably when the force ratio is about 1.25 or less.

As mentioned above, it is preferred that the difference in the material property or properties of the interstitial and binding material be sufficient so that the ball responds differently to different impact forces. While the descriptions above describe the interstitial material becoming increasingly dominant as the force ratio increases, and the binding material becoming increasingly dominant as the force ratio decreases, one skilled in the art would appreciate that alternative embodiments are possible without departing from the spirit and scope of the invention. For instance, in one alternative embodiment, the properties of the binding material may become increasingly dominant when the force ratio is about 2.0 or greater, and more preferably when the force ratio is about 2.25 or greater. In yet another alternative embodiment, the properties of the interstitial material may become increasingly dominant when the force ratio is about 1.75 or less, and more preferably when the force ratio is about 1.25 or less.

Another way to express, describe, or measure the effect of the combination of interstitial and binding materials on the physical characteristics of the intermediate layer is by "spin fraction". The spin fraction is defined as the ratio of the tangential force to the total force caused by a club striking the ball. Referring again to Table 1, the spin fraction becomes increasingly larger as the club selection progresses from driver to half wedge.

It is preferred that the interstitial material properties become increasingly dominant in the effective property of the intermediate layer as the spin fraction becomes increasingly lower. For instance, it is preferred that the interstitial material properties predominate the effective properties of the intermediate layer when the spin fraction is about 0.5 or less, and more preferably when the spin ratio is about 0.36 or less.

Likewise, it is further preferred that the binding material becomes increasingly dominant in the effective properties of the intermediate layer as the spin fraction increases. For instance, it is preferred that the binding material properties predominate when the spin fraction is about 0.6 or greater, and more preferably when the spin fraction is about 0.7 or greater.

Once again, however, one skilled in the art would appreciate that alternative embodiments are possible without departing from the spirit and scope of the present invention. For instance, in one alternative embodiment, the material properties of the binding material may become increasingly dominant when the spin fraction is about 0.5 or less, and more preferably when the spin ratio os about 0.36 or less. In another alternative embodiment, the material properties of the interstitial material may become increasingly dominant when the spin fraction is about 0.6 or greater, and more preferably when the spin fraction is about 0.7 or greater.

Thus, the inventive ball has at least one layer that exhibits at least one transverse or circumferential material property and at least one radial material property where these properties are different. These properties may be, for example, elastic modulus or shear modulus, or any other intrinsic material property governing mechanical behavior. Preferably, the radial material properties are customized to provide a desired driver and long iron performance, while transverse material properties are selected to provide a desired short iron performance. Consequently, the radial and transverse (or circumferential) material directions can be decoupled so that the ball responds differently to different types of impact forces.

The binding material and the interstitial material may be two common core polymers with dissimilar material properties. Alternatively, the binding material and interstitial material may be of dissimilar materials, such as thermoset and thermoplastic materials.

One material property that may differ between the binding material and the interstitial material is the elastic modulus. The result of the combination of the binding material with the interstitial material is that the combination provides an effective elastic modulus of the two materials. The desirable material attributes are achieved by manipulation of the constituents making up the polymeric system. Mechanical properties are typically determined experimentally or approximated by assumptions made about the stress and strain fields under a particular load state. Estimates for the effective elastic modulus, for example, may be calculated using a mechanics of materials approach for composites. To illustrate, the effective elastic modulus of a fiber-matrix composite constructed of two isotropic materials where the fibers are continuous in a planar matrix layer, uniaxially aligned, and perfectly bonded, may be estimated using the rule of mixtures for this type of laminate construction:

$$E_{axial}=E_f+(1-\phi_f)E_m$$

$$E_{trans}=\frac{E_f E_m}{E_m\varphi_f+(1-\varphi_f)E_f}$$

Where:

$E_{axial}$ is the axial effective elastic modulus of the intermediate layer;

$E_{trans}$ is the transverse effective elastic modulus of the intermediate layer;

$E_f$ is the elastic modulus of the interstitial material;

$E_m$ is the elastic modulus of the binding material; and $\phi_f$ is the volume fraction of interstitial material to binding material.

It is preferred that the effective elastic modulus in the axial and transverse directions be sufficiently different so that the ball behaves differently to applied normal or tangential forces. Preferably, the effective elastic modulus of the intermediate layer in the axial, or radial, direction is greater than the effective elastic modulus of the intermediate layer in the transverse, or circumferential, direction. Thus, it is preferred that the ratio of $E_{axial}$ to $E_{trans}$ for the intermediate layer be about 3:1 or greater. This ratio also may be about 5:1 or greater, 8:1 or greater, or even 10:1 or greater, depending on the degree of different ball performance sought.

While the equations provided above provide a suitable generalized form for determining the effective elastic modulus of the intermediate layer in the axial and transverse directions, one skilled in the art would recognize that they may be used to determine the axial and transverse properties of the layer for other material properties as well, such as shear modulus, longtime shear, flexural modulus, bulk modulus, and Poisson's ratio.

In addition, one skilled in the art would also appreciate that alternative methods may be used to approximate the effective material properties of the intermediate layer in the axial and transverse directions without departing from the present invention. For example, it may be possible to utilize the following ASTM standards to determine how the intermediate layer may behave under certain load conditions: ASTM D1646-00 (Standard Test Methods for Rubber-Viscosity, Stress Relaxation, and Pre-Vulcanization Characteristics (Mooney Viscometer)); ASTM D6147-97 (Test Method for Vulcanized Rubber and Thermoplastic Elastomer-Determination of Force Decay (Stress Relaxation) in Compression); ASTM E1876-00 (Standard Test Method for Dynamic Young's Modulus, Shear Modulus, and Poisson's Ratio by Impulse Excitation of Vibration); ASTM E1875-00 (Standard Test Method for Dynamic Young's Modulus, Shear Modulus, and Poisson's Ratio by Sonic Resonance); ASTM E111-97 (Standard Test Method for Young's Modulus, Tangent Modulus, and Chord Modulus); and ASTM D5418-01 (Standard Test Method for Plastics: Dynamic Mechanical Properties: in Flexure (Dual Cantilever Beam)). These alternatives are representative, but not exhaustive and do not exclude from the scope of the invention any additional expressions or test methods that also may be used.

Referring to FIG. 2, in one embodiment of the present invention the binding material 40 may have an elastic modulus substantially different from that of the interstitial material 45. Preferably, the ratio of the interstitial material elastic modulus to the binding material elastic modulus is about 3:1 or greater. More preferably, the ratio may be between about 5:1 and about 10:1. As explained above, this difference in material properties of the interstitial and binding material helps the intermediate layer have different effective material properties in the radial and circumferential directions. For instance, the effective elastic moduli of the intermediate layer may be different in the radial and circumferential directions.

Another such material property that may differ between the binding material and the interstitial material is the long-time shear modulus. Referring again to FIG. 2, the binding material 40 may have a long-time shear modulus substantially different from that of the interstitial material 45. For example, the ratio of the interstitial material long-time shear modulus to the binding material long-time shear modulus may be about 3:1 or greater and more preferably is between about 5:1 and about 10:1. This ratio also may be less than about 30:1.

In addition to varying the differences in material properties between the binding and interstitial materials, the volume fraction may be varied in order to arrive at the desired radial and tangential material properties. The volume fraction is defined as the percentage of interstitial material that is in the intermediate layer. Preferably, the volume fraction of interstitial to binding material is about 30% or less. Alternatively, however, the volume fraction also may be about 40% or less, or even about 60% or less. The volume fraction may even exceed 60% so long as it is possible for the binding material to be formed around the interstitial material.

The intermediate layer also may be of any desired thickness. For instance, the intermediate layer may have a thickness of between about 0.080 inches to about 0.340 inches. Preferably, the intermediate layer is between about 0.125 inches to about 0.250 inches. As explained below, it is preferred that the interstitial material have a length that is considerably longer than its cross sectional area. Thus, it is preferred that the thickness of the intermediate layer is sufficiently thick to allow the interstitial material to have these desired dimensions.

The cover 15 may be tough, cut-resistant, and selected from conventional materials used as golf ball covers based on the desired performance characteristics. The cover may be comprised of one or more layers, such as described in U.S. Pat. Nos. 5,885,172, 6,132,324, 5,803,831, 5,830,087, 5,314,187, 4,431,193, 4,674,751, and 4,274,637, all of which are incorporated by reference. Cover materials such as ionomer resins, blends of ionomer resins, thermoplastic or thermoset urethane, and balata, can be used as known in the art. Examples of these materials can be found in U.S. Pat. Nos. 5,334,673 and 5,484,870. Additionally, cover materials may be made of vinyl resins, polyolefins, polyamides, or acrylic resins.

In one particular embodiment, the present invention can be used in a multilayer golf ball which comprises a core, an inner cover layer, and a thin outer cover layer as described in U.S. Pat. No. 5,885,172. The inner cover layer may be an intermediate layer as described herein. In this embodiment, the core can have a solid or liquid filled center, and also may have additional layers surrounding it, such as windings or additional solid layers. The inner cover layer preferably has a high effective flexural modulus in the normal direction maximizing distance when struck by a driver. The outer cover layer is formed of a relatively soft material, such as a polyurethane, a castable reactive liquid, or the like in order to replicate the soft feel and high spin play characteristics of a balata ball when the ball is used for pitch and other "short game" shots. To further assist in providing a high spin ball during "short game" shots and soft feel of a balata ball, the inner cover layer may be formed of a composite as described herein.

Referring to FIG. 2, the formation of the golf ball 10 starts with forming the core 25. The core 25 and the cover 15 may be formed by compression molding, injection molding, casting, or any other technique know by one of ordinary skill in the art. The intermediate layer 35 also may be formed by any available technique or process that results in the desired configuration of the interstitial material and binding material. Preferably, the intermediate layer is formed by injection molding. If the interstitial material 45 is radially oriented, forming the intermediate layer can include using retractable pins that function in the radial direction to orient the interstitial material and embed it within the binding material if desired. The interstitial material can be formed using a mold cavity with protrusions to place the material.

The interstitial material also may be comprised of small, highly oriented fibers or discrete pieces. For example, the interstitial material may be sufficiently small that it can be combined with the binding material and injected into a cavity around the core. Alternatively, the interstitial material and binding material may be formed as hemispherical cups so that the injecting process disperses and orients the fibers properly.

Referring to FIGS. 3–7, another embodiment of a golf ball 210 is shown. Similar structures to those discussed above use the same reference number preceded with the numeral "2." The golf ball 210 includes a cover 215, a core 225, and a composite intermediate layer 235. The intermediate layer 235 is formed of a binding material 240 and an interstitial material 245 distributed in the binding material. In this embodiment, the intermediate layer 235 is separate from the core 225 and the cover 215, and contacts and extends from the outer surface of the core 225 to the inner surface of the cover 215. The intermediate layer 235 also contacts the inner surface of the cover 215. Thus, the interstitial material 245 contacts the outer surface of the core 225.

Figure 8:
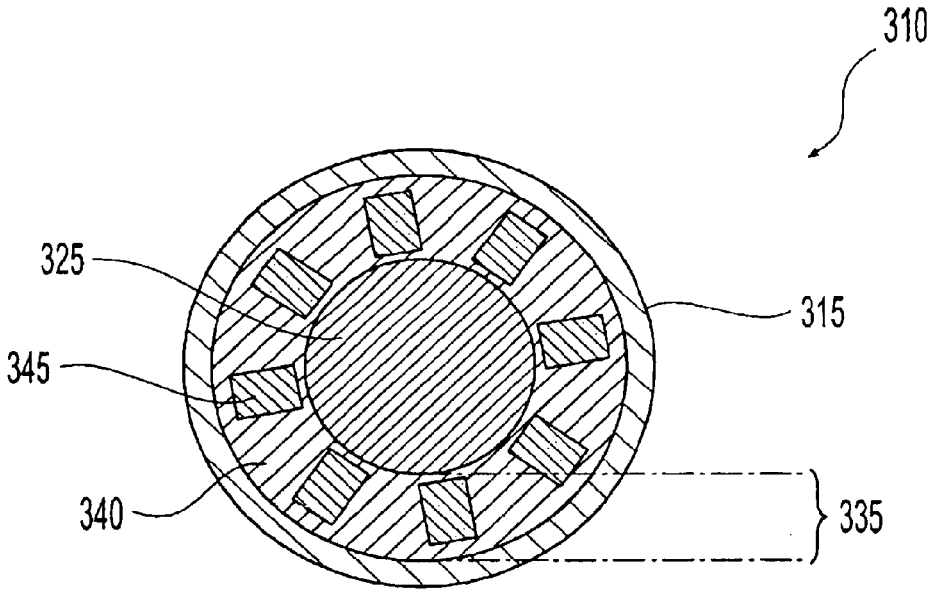
FIG. 8 is a cross-sectional view of a third embodiment of golf ball according to the present invention.

Referring to FIG. 8, another embodiment of a golf ball 310 is shown. Similar structures to those discussed above use the same reference number preceded with the numeral "3." The golf ball 310 includes a cover 315, a core 325, and a composite intermediate layer 335. The intermediate layer 335 is formed of a binding material 340 and an interstitial material 345 distributed in the binding material 340. In this embodiment, the interstitial material 345 is disposed only within the intermediate layer 335 so that the interstitial material is spaced from the outer surface of the core 325 and spaced from the inner surface of the cover 315. In an alternative embodiment, the interstitial material can be spaced for the core but in contact with the inner surface of the cover or embedded therein.

Figure 9:
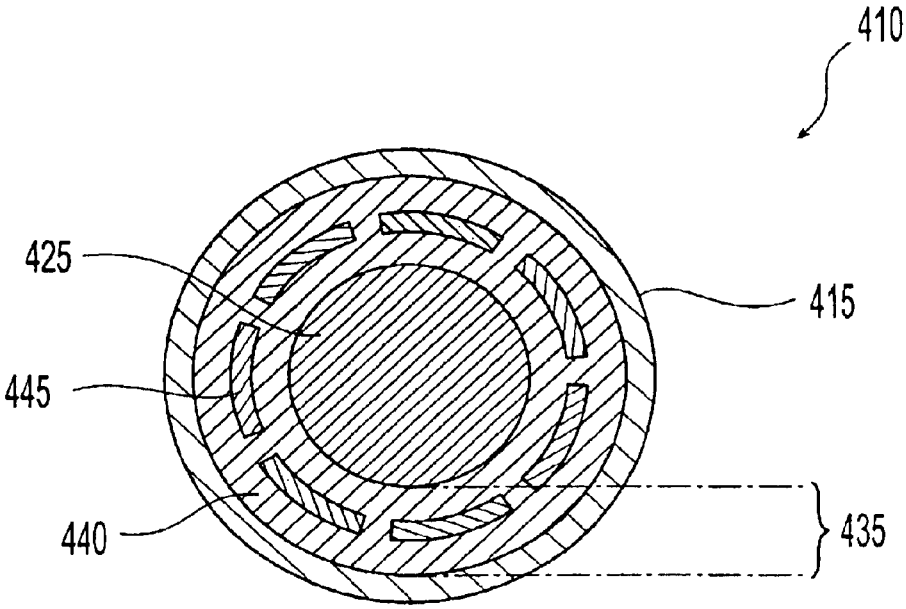
FIG. 9 is a cross-sectional view of a fourth embodiment of golf ball according to the present invention.

Referring to FIG. 9, another embodiment of a golf ball 410 is shown. Similar structures to those discussed above use the same reference number preceded with the numeral "4." The golf ball 410 includes a cover 415, a core 425, and a composite intermediate layer 435. The intermediate layer 435 is formed of a binding material 440 and an interstitial material 445 distributed in the binding material 440. The interstitial material is transversely or circumferentially oriented. In this embodiment, the interstitial material 445 is disposed only within the intermediate layer 435 so that the interstitial material is spaced from the outer surface of the core 425 and spaced from the inner surface of the cover 415. In an alternative embodiment, the interstitial material, embedded in the core and/or the cover, can be spaced from the core but in contact with the inner surface of the cover or embedded only in the cover.

Preferably, the interstitial material is configured so that behaves in a manner similar to fibers or beams. That is, it is preferred that the interstitial material be relatively long in comparison to its cross-sectional area. It is believed that this configuration allows the interstitial material to respond to forces along the axis of the interstitial material in a more rigid manner than to those forces applied transversely or tangentially to the axis. Thus, the response of the intermediate layer subjected to normal forces is predominated by the interstitial material and the response of the intermediate layer subjected to tangential forces is predominated by the binding material. To have this type of response from the intermediate layer, it is preferred that the ratio of the length to cross-sectional area (1/a) of the interstitial material be about 30:1 or greater. The 1/a ratio for the interstitial material also may be about 60:1 or greater, or even about 125:1 or greater. Preferably, however, the ratio of 1/a should be less than about 200:1. If the cross-sectional area of the interstitial material is not uniform, the value of the cross-sectional area for use in this ratio may be determined by using the average cross-sectional area of the interstitial material.

The following three examples illustrate how the features described above may be utilized to create a golf ball having at least one composite layer having different materials properties in the normal and tangential directions. Under typical strain rates for golf ball impacts, instantaneous shear and elastic modulus values can be determined from material testing. While the examples that follow use moduli representative of many golf ball materials, they are not intended to limit the scope or spirit of the present invention to only these materials or to only these examples:

| DIMENSIONS AND FEATURES OF THE INTERMEDIATE LAYER | EXAMPLE 1 | EXAMPLE 2 | EXAMPLE 3 |
|---|---|---|---|
| Layer Thickness (t) | 0.1 inches | 0.3 inches | 0.2 inches |
| Average Binding Material Cross-Sectional Area (A) | 0.002 $in^2$ | 0.0036 $in^2$ | 0.0025 $in^2$ |
| Volume Fraction ($\phi_f$) | 30% | 20% | 10% |
| 1/A | 50 $in^{-1}$ | 83.3 $in^{-1}$ | 80 $in^{-1}$ |
| Interstitial Material Property | $E_f$ = 100 ksi | $G_f$ = 18.1 ksi | $G_f$ = 20 ksi |
| Binding Material Property | $E_m$ = 10 ksi | $G_m$ = 5.95 ksi | $G_m$ = 4 ksi |
| Effective Axial Property | $E_{axial}$ = 107 ksi | $G_{axial}$ = 22.86 ksi | $G_{axial}$ = 23.6 ksi |

-continued

| DIMENSIONS AND FEATURES OF THE INTERMEDIATE LAYER | EXAMPLE 1 | EXAMPLE 2 | EXAMPLE 3 |
|---|---|---|---|
| Effective Transverse Property | $E_{trans}$ = 13.7 ksi | $G_{trans}$ = 6.873 ksi | $G_{trans}$ = 4.3 ksi |
| Ratio of Interstitial to Binding Material Properties | $E_f/E_m$ = 10 | $G_f/G_m$ = 3.04 | $G_f/G_m$ = 5 |
| Ratio of Effective Axial to Transverse Properties | $E_{axial}/E_{trans}$ = 7.8 | $G_{axial}/G_{trans}$ = 3.3 | $G_{axial}/G_{trans}$ = 5.5 |

While it is apparent that the illustrative embodiments of the invention herein disclosed describes the features of the present invention, it will be appreciated that numerous modifications and other embodiments may be devised by those skilled in the art without departing from the spirit and scope of the invention. For example, multiple intermediate layers can be included in the golf ball, some of which may be made as composite layers as described herein and some of which may be made as single materials. The single material layers can be disposed in any location such that they are between the composite intermediate layer and the cover or between the core and the composite intermediate layer. In one embodiment, these additional layers can be formed of core materials, cover materials, or blends thereof. Features of one embodiment can be combined with features of another embodiment. Therefore, it will be understood that the appended claims are intended to cover all such modifications and embodiments which come within the spirit and scope of the present invention.

I claim:

1. A golf ball comprising:

a core;

a cover; and at least one intermediate layer disposed between the cover and core, the intermediate layer comprising a composite of a binding material and an interstitial material that have dissimilar material properties, wherein a first effective material property of the intermediate layer in a first direction is different from a second effective material property in a second direction, and wherein the interstitial material has a long-time shear modulus and the binding material has a binding material long-time shear modulus and the ratio of the interstitial material long-time shear modulus to the binding material long-time shear modulus is about 30:1 or less.

2. The golf ball of claim 1, wherein the first direction of the first effective material property is in the radial direction of the ball and the second direction of the second effective material property is in the circumferential direction of the ball.

3. The golf ball of claim 1, wherein the interstitial material is distributed symmetrically.

4. The golf ball of claim 1, wherein the interstitial material is radially oriented.

5. The golf ball of claim 1, wherein the ratio of the interstitial and binding material long-time shear moduli is between about 5:1 and about 10:1.

6. The golf ball of claim 1, wherein the intermediate layer has a thickness between about 0.080 inches and about 0.340 inches.

7. The golf ball of claim 1, wherein effective material properties of intermediate layer comprise a transverse effective material property and an axial effective material property, and wherein said effective material properties may be estimated as:

$$X_{axial}=X_f+(1-\phi_f)X_m$$

$$X_{trans}=\frac{X_f X_m}{X_m\varphi_f+(1-\varphi_f)X_f}$$

where:

$X_{axial}$ is the axial effective material property of the intermediate layer;

$X_{trans}$ is the transverse effective material property of the intermediate layer;

$X_f$ is the material property of the interstitial material;

$X_m$ is the material property of the binding material; and $\phi_f$ is the volume fraction of interstitial material to binding material.

8. The golf ball of claim 1, wherein the interstitial material is formed of a continuous piece of material.

9. A golf ball comprising:

a core;

a cover; and at least one intermediate layer disposed between the core and the cover, the intermediate layer being formed of a binding material and an interstitial material distributed in the binding material, and wherein the effective elastic modulus of the intermediate layer is lower under forces applied in the radial direction and higher under forces applied in the tangential direction, and wherein the binding material has a binding material elastic modulus and the interstitial material has an interstitial material elastic modulus and the ratio of the interstitial material elastic modulus to the binding material elastic modulus is about 3:1 or greater.

10. The golf ball of claim 9, wherein the interstitial material is distributed symmetrically.

11. The golf ball of claim 9, wherein the interstitial material is radially oriented.

12. The golf ball of claim 9, wherein the ratio of the interstitial and binding material elastic moduli is between about 5:1 and about 10:1.

13. The golf ball of claim 9, wherein the interstitial material has an interstitial material long-time shear modulus and the binding material has a binding material long-time shear modulus and the ratio of the interstitial material long-time shear modulus to the binding material long-time shear modulus is about 30:1 or less.

14. The golf ball of claim 13, wherein the ratio of the interstitial and binding material long-time shear moduli is between about 5:1 and about 10:1.

15. A golf ball comprising:

a core;

a cover; and at least one intermediate layer disposed between the cover and core, the intermediate layer comprising a composite of two dissimilar materials, wherein a first effective material property of the intermediate layer in a first direction is different from a second effective material property in a second direction, and wherein the ratio of the length to cross-sectional area of the interstitial material is about 30:1 or greater.

16. The golf ball of claim 15, wherein the ration of the length to cross-sectional area of the interstitial material is about 60:1 or greater and less than about 200:1.

17. A golf ball comprising:

a core;

a cover; and at least one intermediate layer disposed between the cover and core, the intermediate layer comprising a composite of a binding material and an interstitial material that have dissimilar material properties such that the intermediate layer has effective material properties based upon the material properties of the binding material and the interstitial material, and wherein the interstitial material properties predominate the effective material properties of the intermediate layer when the ratio of normal to tangential forces imparted on the ball when struck by a club is about 2.0 or greater.

18. The golf ball of claim 17, wherein the interstitial material properties predominate the effective material properties of the intermediate layer when the ratio of normal to tangential forces imparted on the ball is about 2.25 or greater.

19. A golf ball comprising:

a core;

a cover; and at least one intermediate layer disposed between the cover and core, the intermediate layer comprising a composite of a binding material and an interstitial material that have dissimilar material properties such that the intermediate layer has effective material properties based upon the material properties of the binding material and the interstitial material, and wherein the binding material properties predominate the effective material properties of the intermediate layer when the ratio of normal to tangential forces imparted on the ball when struck by a club is about 1.75 or less.

20. The golf ball of claim 19, wherein the binding material properties predominate the effective material properties of the intermediate layer when the ratio of normal to tangential forces imparted on the ball is about 1.25 or less.

21. A golf ball comprising:

a core;

a cover; and at least one intermediate layer disposed between the core and the cover, the intermediate layer being formed of a binding material and an interstitial material distributed in the binding material, and wherein the effective elastic modulus of the intermediate layer is lower under forces applied in the radial direction and higher under forces applied in the tangential direction, and wherein the interstitial material has an interstitial material long-time shear modulus and the binding material has a binding material long-time shear modulus and the ratio of the interstitial material long-time shear modulus to the binding material long-time shear modulus is about 30:1 or less.

22. The golf ball of claim 21, wherein the interstitial material is distributed symmetrically.

23. The golf ball of claim 21, wherein the interstitial material is radially oriented.

24. The golf ball of claim 21, wherein the binding material has a binding material elastic modulus and the interstitial material has an interstitial material elastic modulus and the ratio of the interstitial material elastic modulus to the binding material elastic modulus is about 3:1 or greater.

25. The golf ball of claim 21, wherein the ratio of the interstitial and binding material elastic moduli is between about 5:1 and about 10:1.

26. The golf ball of claim 21, wherein the interstitial material has an interstitial material long-time shear modulus and the binding material has a binding material long-time shear modulus and the ratio of the interstitial material long-time shear modulus to the binding material long-time shear modulus is about 30:1 or less.

27. The golf ball of claim 26, wherein the ratio of the interstitial and binding material long-time shear moduli is between about 5:1 and about 10:1.

* * * * *